US005974916A

United States Patent [19]

Lassiter

[11] Patent Number: 5,974,916

[45] Date of Patent: Nov. 2, 1999

[54] WIRENUT DRIVER

[76] Inventor: Daniel T. Lassiter, 9918 Nichols Rd., Windham, Ohio 44288

[21] Appl. No.: 09/012,973

[22] Filed: Jan. 26, 1998

[51] Int. Cl.[6] ..... B25B 13/06

[52] U.S. Cl. ..... 81/121.1; 81/176.2; 81/124.3; 81/60

[58] Field of Search ..... 81/121.1, 124.2, 81/124.6, 58, 58.3, 58.4, 59.1, 60–63.2, 176.1, 176.15, 176.2, 124.3

[56] References Cited

U.S. PATENT DOCUMENTS

| | | | |
|---|---|---|---|
| 445,451 | 1/1891 | Miller | 81/124.4 |
| 838,109 | 12/1906 | Hanes et al. | 81/124.4 X |
| 845,717 | 2/1907 | Miller | 81/121.1 |
| 1,321,776 | 11/1919 | Stepanian | 81/124.2 |
| 4,357,845 | 11/1982 | Cornia | 81/124.2 X |
| 4,823,650 | 4/1989 | Tuttle | 81/124.2 |
| 4,860,618 | 8/1989 | Givot | 81/121.1 |
| 4,867,017 | 9/1989 | Holman | 81/121.1 |
| 5,361,657 | 11/1994 | Terry | 81/124.6 X |

FOREIGN PATENT DOCUMENTS

| | | | |
|---|---|---|---|
| 2245853 | 1/1992 | United Kingdom | 81/121.1 |

*Primary Examiner*—D. S. Meislin
*Attorney, Agent, or Firm*—Sand & Sebolt

[57] ABSTRACT

A wirenut driver includes a ratchet ball which drives a socket. The ratchet ball is formed with a center opening which allows the ratchet ball to receive a stem of the socket in either end thereof for rotation in either the clockwise or counterclockwise direction. The socket is formed with a center bore. The center bore is formed by a plurality of alternating channels and ribs which engage complementary shaped channels and ribs of a wirenut. Rotation of the ratchet ball produces rotation of the socket and wirenut for attaching the wirenut to a plurality of wires for electrically connecting the wires together. A pair of slots are formed in an open end of the socket adjacent the center bore for receiving a wingnut-type wirenut. The inner surface of the center bore may be stepped or tapered to receive various sizes of wirenuts.

17 Claims, 5 Drawing Sheets

WIRENUT DRIVER

BACKGROUND OF THE INVENTION

1. Technical Field

Generally, the invention relates to a wirenut driver. Particularly, the invention relates to a wirenut driver which is used to attach a wirenut onto a plurality of wires for electrically connecting the wires together. Even more particularly, the invention relates to a wirenut driver which receives various sizes and shapes of wirenuts for easily screwing the wirenuts to the plurality of wires using a ratchet motion.

2. Background Information

Wirenuts are used to conductively connect or tie together a plurality of wires. Typically, these wirenuts are used during the installation of lights, electrical switches, electrical outlets, etc. Conventional wirenuts include an outer plastic cap having a ribbed outer surface to facilitate manual twisting thereof. The wirenut is formed with an open bottom end which provides access to a tapered metal insert. The metal insert is attached to the inner surface of the wirenut and is formed with a threaded inner surface. The user aligns an exposed conductive end of each of the wires and inserts the wires into the open end of the wirenut. The user manually screws the wirenut onto the ends of the wires with the threaded inner surface of the metal insert engaging the conductive ends of the wires to electrically connect the wires together and secure the wirenut to the ends of the connected wires. The non-conductive plastic cap of the wirenut prevents the electrical wires from contacting other wires or metal parts within the lighting fixture, switch or electrical outlet.

One problem which exists when installing these wirenuts is that the user must use two hands to gather and align the wires. The user must then take one hand away from the wires to reach for and obtain a wirenut. While the user is reaching for a wirenut of the correct size, the plurality of aligned wires may separate from one another requiring the user to regroup and realign the wires.

Also, these wirenuts are relatively small size making the wirenut difficult to handle. The user will occasionally drop the wirenut during the installation or removal thereof. This is particularly a problem while connecting wires of a ceiling fan or overhead light, for example. The user must stand on a ladder while reaching above his or her head to group, align and connect the wires together with a wirenut. If the user drops the wirenut, the user must climb down the ladder to retrieve the dropped wirenut or to obtain new wirenut, climb back up the ladder and regroup and realign the wires before installing the wirenut.

Further, these wirenuts must be manually screwed to the wires with the user's hands. When installing a large number of wirenuts at one time, the relatively sharp ribs of the wirenut will irritate the user's hands often causing blistering of the user's thumb and fingers.

Therefore, the need exists for a wirenut driver which frictionally holds a wirenut and prevents a user from dropping the wirenut during the installation or removal thereof, and which allows the user to easily screw the wirenut onto a plurality of wires using a ratchet motion.

SUMMARY OF THE INVENTION

Objectives of the present invention include providing a wirenut driver which assists an user in attaching a wirenut to a plurality of wires for electrically connecting the wires together.

A further objective is to provide a wirenut driver which can be used with wirenuts of various sizes and shapes.

Another objective is to provide a wirenut driver which is adapted to receive either a cone-shaped wirenut or a wingnut-type wirenut.

A still further objective is to provide a wirenut driver which may be used to install or remove wirenuts using a ratchet motion.

Another objective is to provide a wirenut driver which may be retained on the wrist of an user during manipulation of the wires and which may be easily flipped into the user's hand to install the wirenut.

A further objective is to provide a wirenut driver which frictionally retains the wirenut therein until the wirenut is to be attached to the wires.

A still further objective is to provide a wirenut driver of simple construction, which achieves the stated objectives in a simple, effective and inexpensive manner, which solves problems and satisfies needs existing in the art.

These objectives and advantages may be obtained by the wirenut driver of the present invention, the general nature of which may be stated as including a socket having a sidewall which forms a center bore, an open first end and a closed second end, said center bore having a diameter which is larger adjacent the open first end of the socket than adjacent the closed second end of the socket; and ratchet means attached to the socket for rotating the socket.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
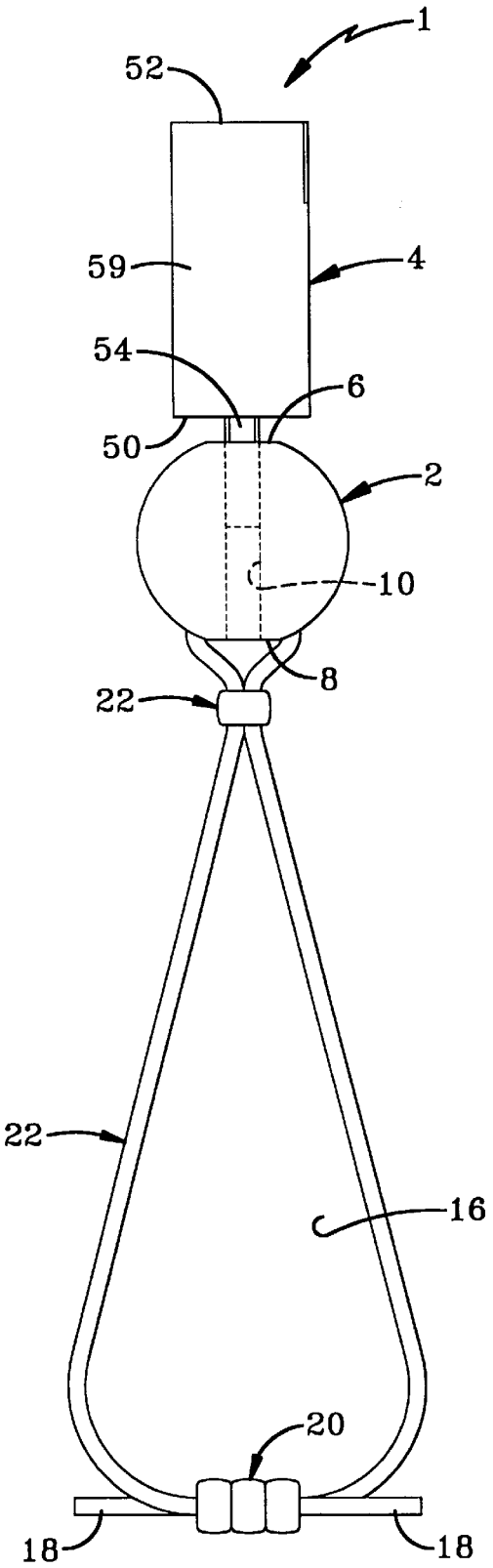
FIG. 1 is a front elevational view of the wirenut driver of the present invention.
Figure 2:
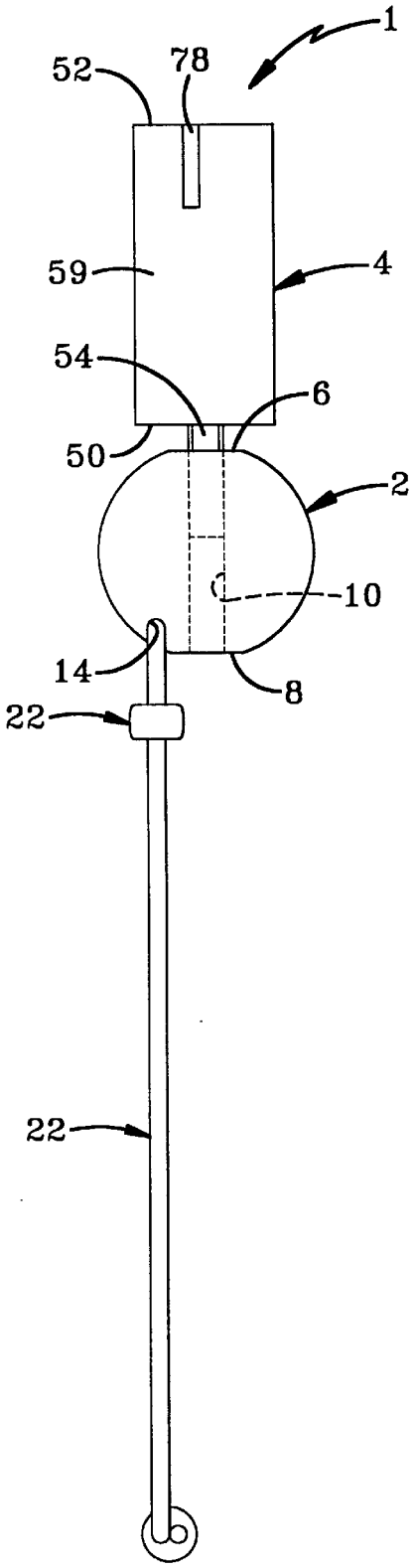
FIG. 2 is a side elevational view of the wirenut driver of FIG. 1.

The wirenut driver of the present invention is shown in FIGS. 1 and 2 and is indicated generally at 1. Wirenut driver 1 includes a ratchet ball 2 and a socket 4. Ratchet ball 2 is a usual plastic spherical-shaped member having an internal ratchet mechanism. Ratchet ball 2 includes diametrically opposed flat end surfaces 6 and 8 and is formed with a center opening 10 which extends between end surfaces 6 and 8. Center opening 10 is square in cross-section for receiving and driving socket 4, as described below. Ratchet ball 2 includes an adjustable wrist strap 12 which allows wirenut driver 1 to be secured to a user's wrist during use thereof. Wrist strap 12 extends through a hole 14 which is formed in ratchet ball 2 adjacent end surface 8. Wrist strap 12 forms a looped opening 16 for receiving the user's wrist therethrough. The length of wrist strap 12 may be adjusted by pulling one of a pair of ends 18 of the wrist strap which are threaded through and frictionally held in position by a set of beads 20. Another bead 22 is positioned on wrist strap 12 opposite beads 20 and adjacent end surface 8 for adjusting the size of looped opening 16. Adjustment bead 22 slides toward or away from ratchet ball 2 for loosening or tightening, respectively, wrist strap 12 around the user's wrist.

Figure 5:
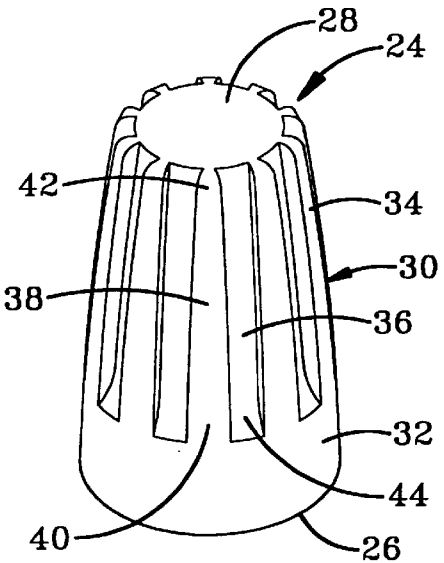
FIG. 5 is a perspective view of a cone-shaped wirenut.
Figure 4:
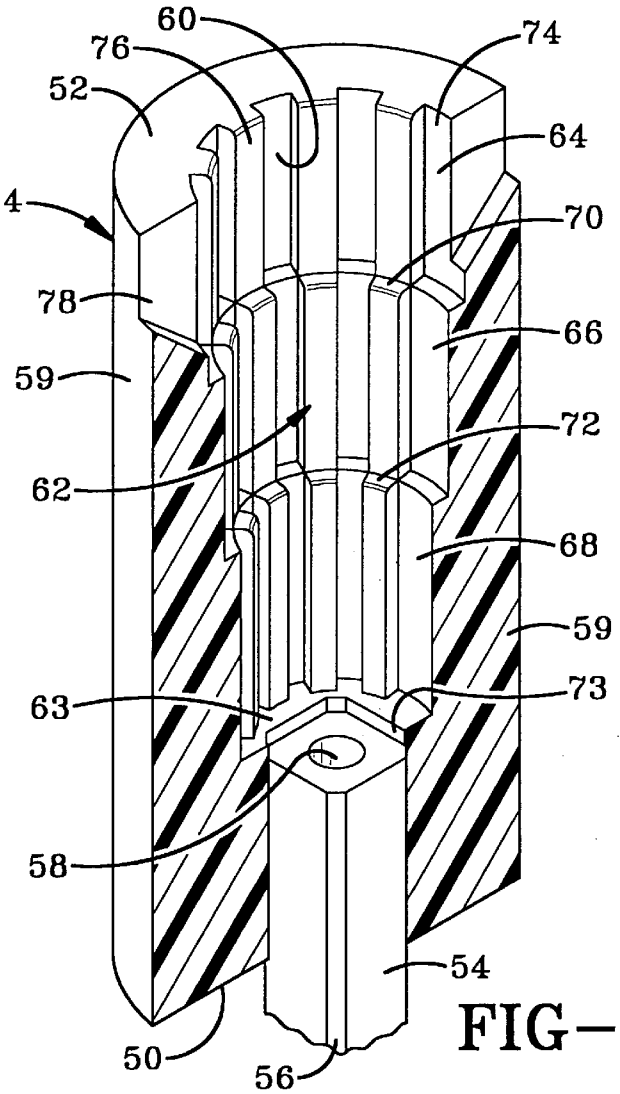
FIG. 4 is a perspective sectional view taken along line 4—4, FIG. 3.
Figure 3:
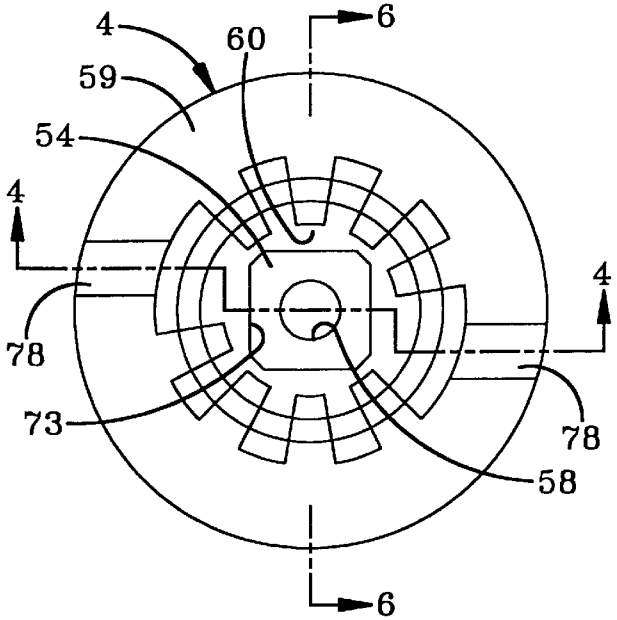
FIG. 3 is an end view of the wirenut driver of FIG. 1.

In accordance with one of the features of the invention, socket 4 receives various sizes wirenuts for attaching the wirenuts to a plurality of wires for electrically connecting the wires together. A standard cone-shaped wirenut is shown in FIG. 5 and is indicated at 24. Cone-shaped wirenut 24 includes an open bottom end 26, a flat top end 28 and a tapered outer surface 30 extending therebetween. Outer surface 30 includes a smooth lower section 32 and a ribbed upper section 34. Ribbed upper section 34 has a length which is substantially greater than that of smooth lower section 32 and is formed by a plurality of alternating channels 36 and ribs 38. A standard wirenut includes ten of each of channels 36 and ribs 38. Each rib 38 has a width which is tapered from a lower end 40 to an upper end 42 thereof. Lower end 40 of each rib 38 is formed integrally with smooth lower section 32 of outer surface 30. Upper end 42 of each rib 38 has a curved outer surface at the intersection of rib 38 and top end 28 of wirenut 24.

Figure 8:
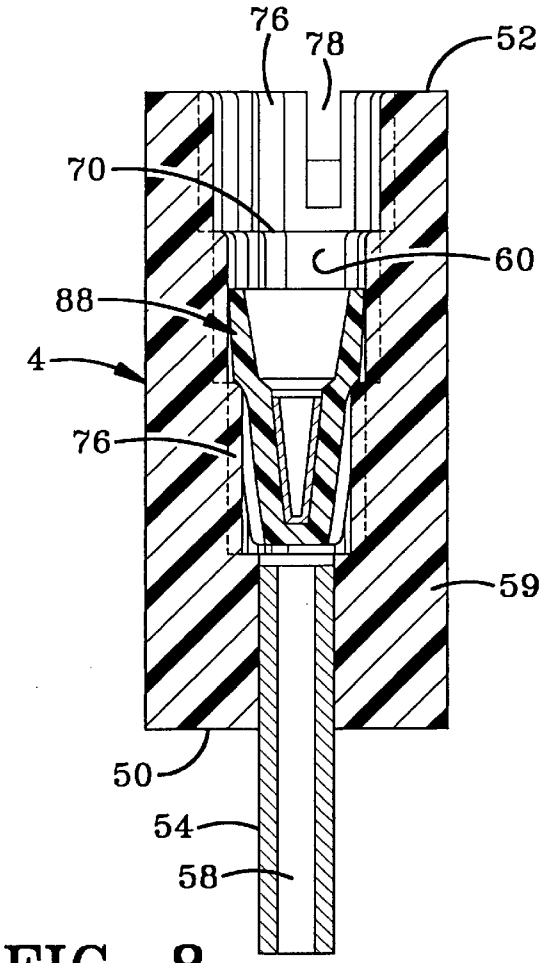
FIG. 8 is a sectional view similar to FIG. 7 showing the wirenut driver holding a small cone-shaped wirenut.
Figure 7:
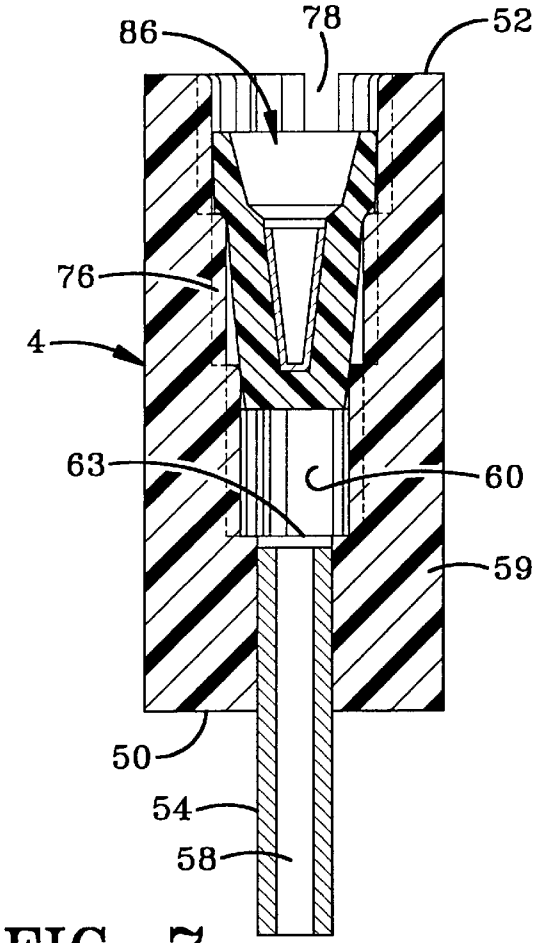
FIG. 7 is a sectional view similar to FIG. 6 showing the wirenut driver holding a medium sized cone-shaped wirenut.
Figure 6:
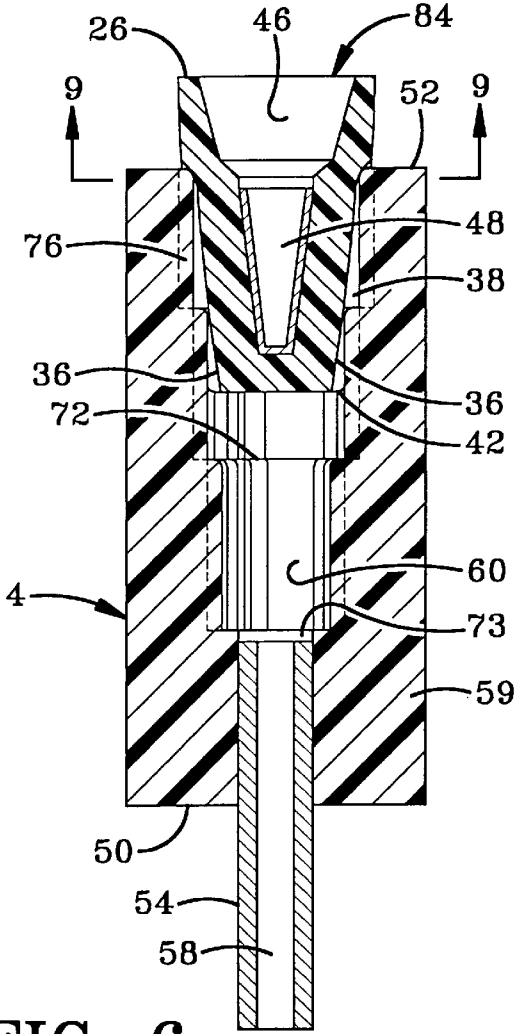
FIG. 6 is a sectional view taken along line 6—6, FIG. 3 showing the wirenut driver holding a large cone-shaped wirenut.
Figure 9:
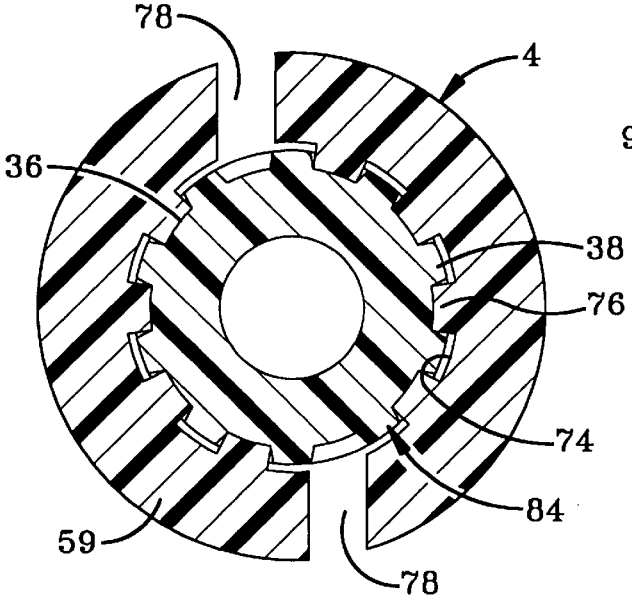
FIG. 9 is a sectional view taken along line 9—9, FIG. 6.

Tapered ribs 38 allow channels 36 to be formed with a constant width along the entire length thereof. Channels 36 have a curved lower end 44 which form a smooth ramped surface from smooth lower section 32 of outer surface 30 to the flat inner surface of channels 36. Open bottom end 26 of wirenut 24 provides access to a generally cone-shaped cavity 46 (FIGS. 6–8). Cavity 46 includes a metal insert 48 having a threaded inner surface for receiving and conductively connecting together a plurality of wires, as described below.

In accordance with another of the features of the invention, socket 4 is generally tubular and includes a cylindrical wall 59 (FIGS. 3, 4 and 6–8) which forms an inner center bore 60, a closed top end 50 and an open bottom end 52. A stem 54 which is generally square in cross-section and includes beveled corners 56, extends outwardly from top end 50. Stem 54 is formed with a central circular bore 58. Stem 54 is received within center opening 10 of ratchet ball 2 during use of wirenut driver 1, as described below.

Center bore 60 is formed with a stepped inner surface 62 and an inner end wall 63. Stepped inner surface 62 includes a first outer section 64, a second middle section 66 and a third inner section 68. Outer section 64 has a diameter which is larger than that of middle section 66 and is separated from middle section 66 by a first step 70. Middle section 66 has a diameter which is larger than that of inner section 68 and is separated from inner section 68 by a second step 72. Inner end wall 63 is formed with an opening 73 which allows bore 58 of stem 54 to communicate with center bore 60 of socket 4. The diameter of outer section 64, middle section 66 and inner section 68 allows socket 4 to receive and frictionally retain a large wirenut 84 (FIG. 6), a medium wirenut 86 (FIG. 7) or a small wirenut 88, as described below.

In accordance with another of the features of the invention, stepped inner surface 62, and particularly outer section 64, middle section 66 and inner section 68 thereof, is formed with a plurality of alternating channels 74 and ribs 76. Ribs 76 of each section 64, 66 and 68 include a truncated inner surface 77 and are tapered (FIG. 3) inwardly. Ribs 76 of outer section 64 have a width slightly larger than a width of ribs 76 of middle section 66. Ribs 76 of middle section 66 have a width slightly larger than a width of inner section 68. Channels 74 of outer section 66 have a width slightly larger than a width of channels 74 of middle section 66. Channels 74 of middle section 66 have a width slightly larger than a width of channels 74 of inner section 68. Both channels 74 and ribs 76 are formed with first and second steps 70 and 72, respectively.

Figure 10:
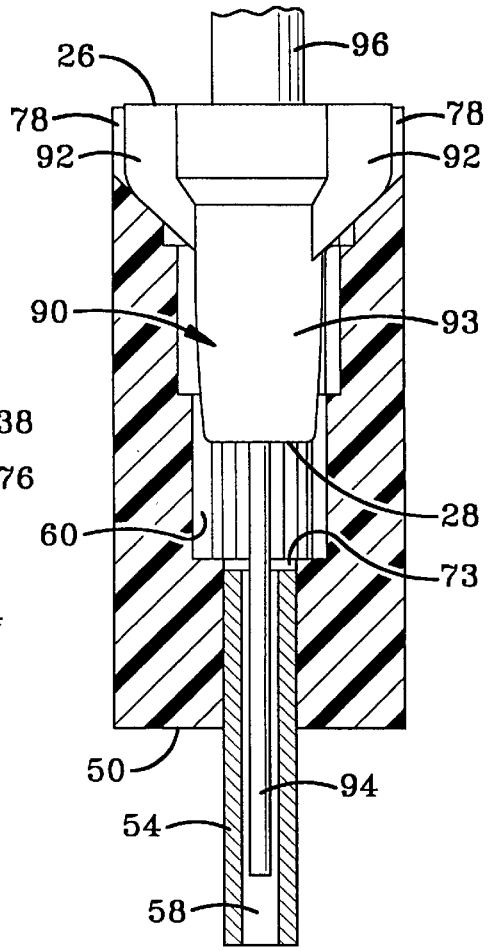
FIG. 10 is a sectional view showing the wirenut driver holding a wingnut-type wirenut.
Figure 11:
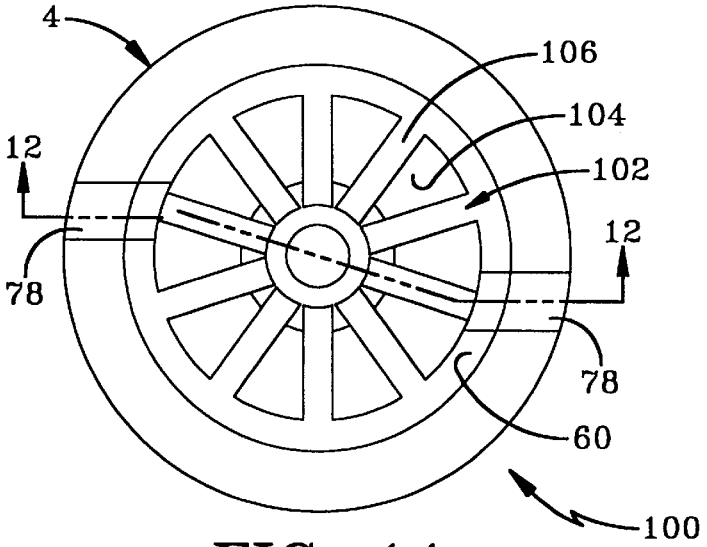
FIG. 11 is an end view of a second embodiment of the wirenut driver of the present invention.

A pair of slots 78 (FIGS. 2, 3 and 10) are formed in cylindrical wall 59 of socket 4 adjacent open bottom end 52 to allow wirenut driver 1 to receive and install a wingnut-type wirenut 90. Wingnut wirenut 90 (FIG. 10) is substantially similar to wirenuts 24, 84, 86 and 88 but includes a pair of wings or tabs 92 which extend outwardly from the outer surface thereof adjacent open bottom end 26. Wings 92 provide a protruding surface which allows the user to rotate wirenut 90 onto the plurality of wires. Wingnut 90 may include a ribbed outer surface similar to outer surface 30 of wingnut 24, but is shown in FIG. 10 having a smooth outer surface 93. A center opening may be formed in top end 28 of wingnut 90 for receiving an elongated wire 94 which is not to be connected to the other wires therethrough.

In use, stem 54 of wirenut driver 1 is inserted into center opening 10 of ratchet ball 2 adjacent end surface 8, whereby rotation of ratchet ball 2 in the clockwise direction rotates socket 4, and rotation of ratchet ball 2 in a counterclockwise direction will not rotate socket 4. The user's hand is inserted through looped opening 16 of wrist strap 12. Beads 20 and 22 are adjusted until wrist strap 12 fits snugly around the user's wrist and has a length which allows the user to grasp ratchet ball 2 in the palm of his or her hand. One of the wirenuts is inserted within center bore 60 of socket 4 with ribs 38 of the wirenuts aligned with channels 74 of stepped inner surface 62 of socket 4, and channels 36 of the wirenut aligned with ribs 76 of stepped inner surface 62.

As shown in FIG. 6, large wirenut 84 is inserted within center bore 60 until curved lower end 44 of channels 36 abuts second end 52 of socket 4. Ribs 38 of wirenut 84 extend within channels 74 of socket 4 and ribs 76 of socket 4 extend within channels 36 of wirenut 84 a sufficient distance whereby rotation wirenut driver 1 in the clockwise direction rotates wirenut 84. As described above, ribs 76 form an inner diameter of outer section 64 which allows ribs 76 to contact the inner surface of channels 36 of wirenut 84 and frictionally retain wirenut 84 within socket 4.

The plurality of wires which are to be electrically connected together are inserted within cavity 46 of wirenut 84 until an exposed metal end of the wires contacts metal insert 48 of wirenut 84. Wirenut driver 1 is rotated using a ratchet motion causing threaded inner surface of metal insert 48 to cut or bite into the soft, malleable metal ends of the wires. Wirenut driver 1 is rotated until wirenut 84 has been screwed and tightened onto the ends of the wires. Wirenut 84 electrically connects the wires together and provides a plastic non-conductive cover to the wires which prevents the wires from arcing with or contacting another metal surface or wire.

Medium wirenut 86 is shown in FIG. 7 inserted within center bore 60. Medium wirenut 86 extends within bore 60 until curved lower ends 44 of channels 36 abut first step 70 of stepped inner surface 62. Wirenut 86 extends within center bore 60 a sufficient distance to allow ribs 38 of wirenut 86 to engage channels 74 of socket 4, and ribs 76 of socket 4 to engage channels 36 of wirenut 86. Ribs 76 form an inner diameter of middle section 66 which allows ribs 76 to contact the inner surface of channels 36 of wirenut 86 and frictionally retain wirenut 86 within socket 4. Medium wirenut 86 is attached to a plurality of wires in a manner similar to that described above for large wirenut 84.

Small wirenut 88 is shown in FIG. 8 inserted within center bore 60. Small wirenut 88 extends within bore 60 until curved lower end 44 of channels 36 abut second step 72 of stepped inner surface 62 of socket 4. Small wirenut 88 extends within bore 60 a sufficient distance to allow ribs 38 of wirenut 88 to engage channels 74 of socket 4, and ribs 76 of socket 4 to engage channels 36 of wirenut 88. Ribs 76 form an inner diameter of inner section 68 which allows ribs 76 to contact the inner surface of channels 36 of wirenut 88 and frictionally retain wirenut 88 within socket 4. Small wirenut 88 is attached to a plurality of wires in a manner similar to that described above for large wirenut 84.

Wirenut driver 1 may also be used to remove an installed wirenut from a plurality of wires. Stem 54 of socket 4 is inserted within center opening 10 of ratchet ball 2 adjacent end surface 8, whereby rotation of ratchet ball 2 in the counterclockwise direction rotates socket 4 in the counterclockwise direction, and rotation of ratchet ball 2 in the clockwise direction does not rotate socket 4 in the clockwise direction. Ribs 38 of the wirenut are aligned with channels 74 of socket 4 and ribs 76 of socket 4 are aligned with channels 36 of the wirenut. Socket 4 is positioned over the installed wirenut until bore 60 receives the wirenut in one of the manners described above. Wirenut driver 1 is rotated in the counterclockwise direction using a ratchet motion to unscrew the wirenut from its attachment to the wires. The wirenut is removed from the wires exposing the metal ends of the wires for subsequent manipulation thereof. The friction-fit between the inner surface of bore 60 and the respective sizes of wirenuts allows socket 4 to retain the wirenut therein preventing the user from dropping or losing the wirenut.

In accordance with another of the features of the invention, socket 4 may be rotated by the user's fingers with ratchet ball 2 grasped in the user's palm. The ratchet mechanism of ratchet ball 2 allows the user to grasp socket 4 with his or her thumb and index finger and rotates socket 4 allowing the user to install a wirenut using one hand. Additionally, wrist strap 12 allows the user to retain wirenut driver 1 on the user's wrist allowing the user to manipulate the wires using both hands. When the user wishes to install the wirenut, the user may "flip" wirenut driver 1 from its dangling position on the user's wrist into the user's hand for installation of the wirenut. Because of the friction fit of the wirenuts within socket 4, the wirenut may be preinstalled within wirenut driver 1 and retained therein during gathering and aligning of the wires. When the user wishes the install the wirenut, he or she merely flips wirenut driver 1 into his or her hand, positions the wirenut over the exposed ends of the wires and uses the thumb and index finger method of rotating socket 4 for quick and easy installation of the wirenut.

Wirenut driver 1 may also be used to install wingnut wirenut 90 (FIG. 10). Wingnut wirenut 90 is inserted within center bore 60 of socket 4 with wings 92 thereof extending within slots 78. With wings 92 inserted within slots 78, rotation of socket 4 will cause the spaced portions of cylindrical wall 59 adjacent slots 78 to apply a pressure on wings 92 thus rotating wingnut wirenut 90 for installation thereof on a the wires, as described above.

An electrical cord or cable 96 (FIG. 10) may include a plurality of individually insulated wires, one of which is not to be connected to the others. The user may cut the wires whereby one elongated wire 94 has a length greater than that of the other wires. Wire 94 may be inserted through the hole of wirenut 90 allowing wire 94 to extend through opening 73 of inner end wall 63 of socket 4, through bore 58 of stem 54, and through opening 10 of ratchet 2. Thus, rotation of wirenut driver 1 and wirenut 90 will not electrically connect wire 94 with the other wires.

A second embodiment of the wirenut driver of the present invention is shown in FIGS. 11–14 and is indicated generally at 100. Wirenut driver 100 is substantially similar to wirenut driver 1 with the exception of the inner surface of center bore 60 of socket 4. Bore 60 of wirenut driver 100 includes a ribbed tapered inner surface 102 formed by a plurality of alternating channels 104 and ribs 106. Channels 104 and ribs 106 are formed in a generally complementary relationship to ribs 38 and channels 36, respectively, of wirenut 24. As described above, ribs 38 of the wirenuts are tapered in width allowing channels 36 of the wirenuts to have a constant width. To allow tapered inner surface 102 of wirenut driver 100 to engage the various sizes of wirenuts, channels 104 of socket 4 are tapered from bottom end 52 to inner end wall 63 to receive tapered ribs 38 of the wirenut, and ribs 106 of socket 4 are formed with a constant width along the entire length thereof allowing channels 36 of the wirenut to receive ribs 106 therein.

Figure 12:
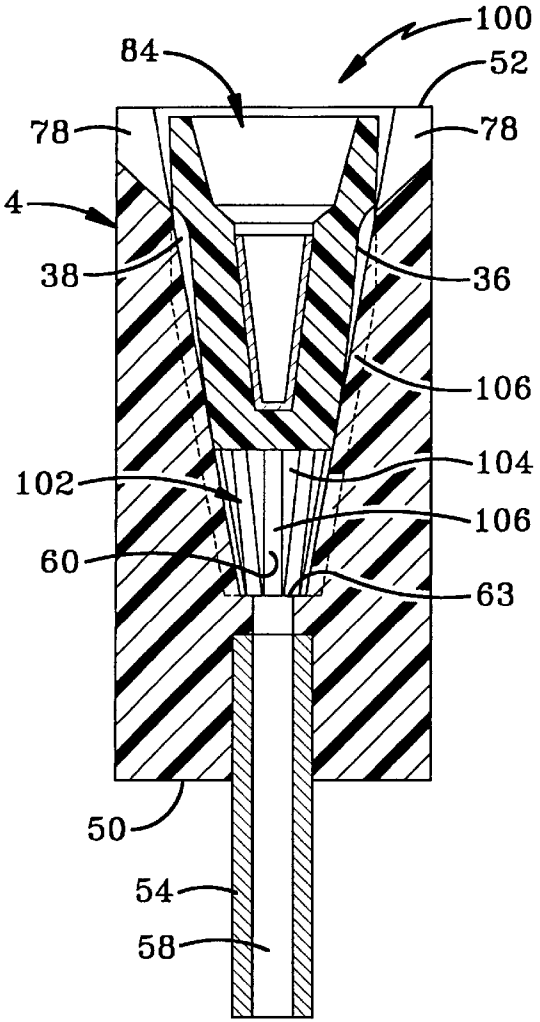
FIG. 12 is a sectional view taken along line 12—12, FIG. 11 showing the wirenut driver holding a large cone-shaped wirenut.
Figure 13:
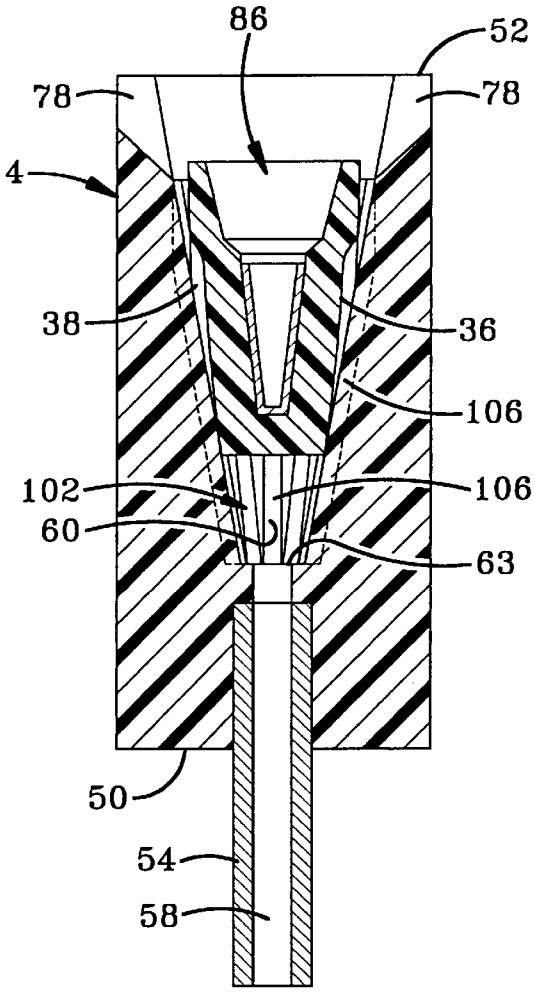
FIG. 13 is a sectional view similar to FIG. 12 showing the wirenut driver holding a medium sized cone-shaped wirenut.
Figure 14:
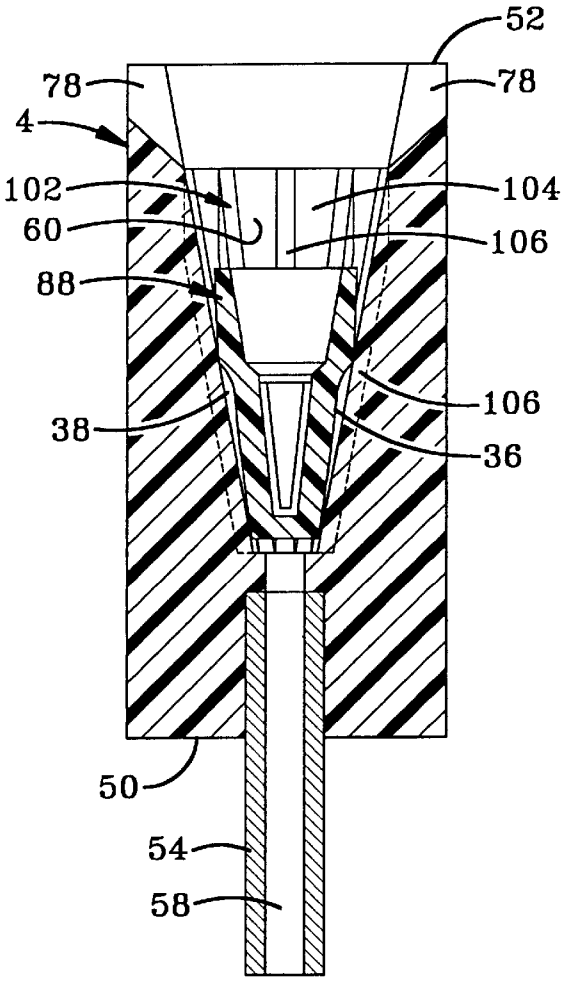
FIG. 14 is a sectional view similar to FIG. 13 showing the wirenut driver holding a small cone-shaped wirenut.

Large wirenut 84 is shown in FIG. 12 inserted within socket 4 of wirenut driver 100. Large wirenut 84 extends within bore 60 until curved upper end 42 of ribs 38 wedge against the inner surface of channels 104 to frictionally retain wirenut 84 within bore 60. Wirenut 84 extends within bore 60 a sufficient distance to allow ribs 38 of wirenut 84 to extend within channels 104 of socket 4 and ribs 106 of socket 4 to extend within channels 36 of wirenut 84.

Medium wirenut 86 and small wirenut 88 are inserted within bore 60 of wirenut driver 100 in a similar manner to that described above for large wirenut 84. The curved upper end 42 of ribs 38 of each respective sized wirenut will eventually contact inner surface 102 of socket 4 wedging the wirenut within bore 60 to frictionally retain the wirenut therein. Wirenut driver 100 is rotated in a similar manner as wirenut driver 1 to install wirenuts 84, 86 and 88 to a plurality of wires for electrically connecting the wires together.

Accordingly, wirenut drivers 1 and 100 include a ratchet ball 2 which drives a socket 4 using a ratchet motion for attaching a wirenut to a plurality of wires which are to be electrically connected together. The wirenut is inserted within bore 60 of socket 4 a sufficient distance to allow the channels and ribs of the inner surface of the socket to engage the respective ribs and channels of the wirenut. Bore 60 may include a stepped inner surface 62 which receives and frictionally retains a large, medium or small wirenut, or a ribbed tapered inner surface 102 which allows the wirenut to wedge thereagainst to frictionally retain the wirenut within bore 60. Stem 54 of socket 4 is formed with bore 58 to allow an elongated wire 94 to extend therethrough free of electrical connection to the other wires. Slots 78 allow wings 92 of wingnut wirenut 90 to extend therein allowing socket 4 to receive and rotate a wingnut wirenut. Ratchet ball 2 is formed with center opening 10 which allows stem 54 of socket 4 to be placed within either end of the ratchet ball allowing ratchet ball 2 to be rotated either in the clockwise or counterclockwise direction.

Accordingly, the improved wirenut driver is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved wirenut driver is constructed and used, the characteristics of the construction, and the advantageous, new and useful results obtained, the new and useful structures, devices, elements, arrangements, parts and combinations, are set forth in the appended claims.

I claim:

1. A wirenut driver system for connecting a wirenut to at least one wire, said system including:

a socket having a sidewall which forms a center bore, an open first end and a second end, said center bore having a diameter which is larger adjacent the open first end of the socket than adjacent the second end of the socket;

a stem connected to the socket; the stem extending out from the second end of the socket; the stem having a through bore that communicates with the center bore of the socket; and ratchet means attached to the socket for rotating the socket; the ratchet means having a center opening extending through the ratchet means and communicating with the through bore of the stem thus providing a passageway entirely through the wirenut driver assembly.

2. The system defined in claim 1 in which the sidewall of the socket includes an inner surface which is formed with a plurality of alternating ribs and channels.

3. The system defined in claim 2 in which the ribs and channels of the inner surface of the sidewall extend longitudinally between the open first end of the socket and second end of the socket.

4. The system defined in claim 3 in which the inner surface of the sidewall is stepped inwardly from the open first end of the socket to the second end of the socket.

5. The system defined in claim 4 in which the ribs have a width which is tapered inwardly from the sidewall; and in which the ribs are truncated to form an inner surface, said inner surface of the ribs being adapted to abut a channel of the wirenut for frictionally retaining the wirenut within the center bore of the socket.

6. The system defined in claim 5 in which the width of the ribs is larger adjacent the open first end of the socket than adjacent the second end of the socket.

7. The system defined in claim 3 in which the inner surface of the sidewall of the socket is tapered from the open first end of the socket to the second end of the socket.

8. The system defined in claim 7 in which the ribs have a constant width along the longitudinal length thereof.

9. The system defined in claim 7 in which the channels have a width which is tapered longitudinally from the open first end of the socket to the second end of the socket.

10. The system defined in claim 1 in which the socket is cylindrical in shape.

11. The system defined in claim 1 further including an adjustable wrist strap which extends from the ratchet means.

12. The system defined in claim 1 further including a pair of slots formed in the sidewall of the socket adjacent the open first end, said slots being adapted to receive a pair of wings of a wingnut wirenut.

13. In combination, a socket for receiving and installing a wirenut, a wirenut, and a wire; said socket including:

a tubular member having a wall, an open first end and a second end;

a center bore formed in the tubular member by an inner surface of the wall, said center bore having a diameter which is larger adjacent the first open end of the socket than adjacent the second end of the socket; the inner surface of the wall being formed with a plurality of ribs and channels that extend longitudinally along the tubular member; and a stem extending outwardly from the second end of the socket, the stem having a through bore that is in communication with the center bore; the wirenut disposed in the center bore of the tubular member and the wire extending through the wirenut and through the through bore of the stem.

14. The socket defined in claim 13 the inner surface of the sidewall is stepped inwardly from the open first end of the socket to the second end of the socket.

15. The socket defined in claim 14 in which each of the ribs have a width which is larger adjacent the open first end of the socket than adjacent the second end of the socket; in which the width of the ribs is tapered inwardly from the wall; and in which the ribs are truncated to form an inner surface.

16. The socket defined in claim 13 in which the inner surface of the wall of the socket is tapered from the open first end of the socket to the second end of the socket.

17. The socket defined in claim 13 in which the ribs have a constant width along the longitudinal length thereof; and in which the channels have a width which is tapered longitudinally from the open first end of the socket to the second end of the socket.

* * * * *